US006039062A

United States Patent [19]

Karakaedos

[11] Patent Number: 6,039,062

[45] Date of Patent: Mar. 21, 2000

[54] COMBINED PORTABLE UMBRELLA AND AIR BLOWER

[76] Inventor: Glen Karakaedos, 43 Saunders Rd., Lynn, Mass. 01904

[21] Appl. No.: 09/072,762

[22] Filed: May 5, 1998

[51] Int. Cl.[7] ..... A45B 3/00; A47L 5/24

[52] U.S. Cl. ..... 135/16; 135/20.3; 135/25.41; 135/48; 15/344; 15/405

[58] Field of Search ..... 135/16, 19.5, 20.3, 135/24, 44, 48, 25.41; 15/344, 405, 410; 248/156

[56] References Cited

U.S. PATENT DOCUMENTS

| | | | |
|---|---|---|---|
| 1,148,332 | 7/1915 | Onyskow . | |
| 2,729,220 | 1/1956 | Smyrnow . | |
| 3,177,881 | 4/1965 | Covington . | |
| 3,444,799 | 5/1969 | Covington . | |
| 3,739,792 | 6/1973 | Holland | 135/16 |
| 3,999,243 | 12/1976 | La Pour . | |
| 4,945,604 | 8/1990 | Miner et al. . | |
| 5,007,811 | 4/1991 | Hopkins . | |
| 5,172,711 | 12/1992 | Mueller et al. . | |
| 5,207,238 | 5/1993 | Rivera et al. . | |
| 5,323,798 | 6/1994 | Yang | 135/16 |
| 5,349,975 | 9/1994 | Valdner . | |
| 5,449,012 | 9/1995 | Friedman . | |

FOREIGN PATENT DOCUMENTS

| | | | |
|---|---|---|---|
| 1252379 | 10/1967 | Germany | 135/17 |

*Primary Examiner*—Michael Safavi
*Assistant Examiner*—Winnie Yip
*Attorney, Agent, or Firm*—O'Connell Law Firm

[57] ABSTRACT

A combined portable umbrella and air blower comprising an elongate shaft, an umbrella canopy coupled to the elongate shaft for providing protection from adverse weather conditions, and an air propulsion mechanism operably coupled to the elongate shaft for enabling a clearing of debris from an external surface. Air may be propelled through an air conduit that comprises an elongate hollow tube that is devoid of air-conveying openings therealong, that is disposed within the elongate shaft, and that has an air outlet coincident with a first end of the elongate shaft. A nozzle may be disposed at the first end of the elongate shaft for focusing and directing propelled air. A removable, protective cap with a ground-engaging spike may be attachable to the air outlet and retained by a tether. The air propulsion mechanism and a power source therefor may be selectively couplable to the combined portable umbrella and air blower, and a replacement member may be substituted therefor whereby the combined portable umbrella and air blower may be employed solely as an umbrella when a clearing of debris is not required.

15 Claims, 2 Drawing Sheets

COMBINED PORTABLE UMBRELLA AND AIR BLOWER

FIELD OF THE INVENTION

This invention relates generally to umbrellas and air propulsion devices. More particularly, the present invention relates to a portable umbrella in combination with an air blower for enabling a clearing of leaf debris and the like that may obstruct the path of a golf ball on a golf green thereby to improve a player's putting ability.

BACKGROUND OF THE INVENTION

It was recognized by the present inventor while playing a round of golf that golf greens often contain debris such as leaves that are blown onto the surface of the green, particularly in the fall of the year. More often than not, such debris is in the putting path of the golf ball and, if not physically cleared by the golfer, can deflect the golf ball during putting thereby interfering with play and increasing the golfer's score. To clear the golf green of such debris, the golfer has to attempt to push the debris to the side, out of the way, using a golf club, a shoe or his or her hand. This is inconvenient, and, where one attempts to use his or her shoe, the spikes on the golf shoe can damage the putting surface and further impair play.

U.S. Pat. No. 3,999,243 to La Pour shows a leaf and debris blower for golf greens that clears obstructions such as leaves in preparation for putting the golf ball. A battery driven fan in a housing directs airflow through slits in a golf club head supported by a brush thereon to blow the leaves from the green thereby clearing a path for the golf ball prior to putting. Unfortunately, however, the La Pour device suffers from a plurality of disadvantages. For example, it is unlikely that one could easily use the device for any purpose other than to remove debris; its bulk and projecting brush device would effectively prohibit a user from actually using the invention as a golf club. Furthermore, it certainly would not provide protection from adverse weather conditions.

Accordingly, it becomes clear that there is a great need for an apparatus that provides protection from the elements while simultaneously providing a means for conveniently removing debris from a surface such as a golf green.

SUMMARY OF THE INVENTION

It is therefore an object of this invention to provide an apparatus for providing protection from adverse weather conditions while allowing a convenient clearing of leaf debris and the like from a surface at a low cost.

It is also an object of this invention to provide an apparatus with a combined portable umbrella and air blower for enabling a clearing of debris from a surface such as a golf green by air propelled from the air blower.

It is a further object of this invention to provide an apparatus having the convenient option of using an umbrella portion for providing protection from adverse weather conditions independently and devoid of the air blower portion when debris clearing is not needed.

Still another object of the present invention is to provide an apparatus that is simple in design, simple to manufacture, and low in cost.

These and other objects are met by the present invention for an apparatus for a combined portable umbrella and air blower that enables a clearing of leaf debris and the like from the path of a golf ball from a golf green. In a most basic embodiment, the invention essentially comprises a portable umbrella in combination with an air blower for enabling a clearing of debris from a surface by air propelled from the air blower while enabling a protection from adverse weather conditions by the umbrella.

Stated more particularly, the combined portable umbrella and air blower may comprise an elongate shaft with a first end and a second end; an umbrella canopy coupled to the elongate shaft adjacent to the first end thereof wherein the umbrella canopy projects radially from the elongate shaft when in an open position for providing protection from adverse weather conditions; and an air propulsion mechanism operably coupled to the elongate shaft for enabling a clearing of debris from a surface external to the combined umbrella and air blower by propelled air.

This most basic embodiment of the invention is rendered still more useful when the elongate shaft comprises a first shaft section and a second shaft section, where the umbrella canopy is coupled to the first shaft section, where the air propulsion mechanism and a power source casing are coupled to the second shaft section, and where the air propulsion mechanism and the power source casing can be removed from the first shaft section by disengaging the second shaft section from the first shaft section when it is apparent that the air blower is not needed or desired thereby rendering the combined portable umbrella and air blower more manageable.

Still further advantage is provided by using a replacement member with a hand grip coupled thereto and a means for selectively coupling the replacement member to the first shaft section whereby the device can be used independently as a traditional umbrella devoid of an air blower when debris clearing is not needed.

According to another aspect of the invention, the combined portable umbrella and air blower includes an air conduit operatively associated with the elongate shaft wherein the air conduit has a first end comprising an air outlet and a second end comprising an air inlet and wherein the air propulsion mechanism is operably associated with the air conduit for drawing air into the air inlet and propelling air from the air outlet.

One skilled in the art will realize that the foregoing discussion broadly outlines the more important features of the invention to enable a better understanding of the detailed description that follows and to instill a better appreciation of the inventor's contribution to the art. Before an embodiment of the invention is explained in detail, it must be clear that the following details of construction, descriptions of geometry, and illustrations of inventive concepts are mere examples of possible manifestations of the invention.

DETAILED DESCRIPTION OF A PREFERRED EMBODIMENT

Figure 1:
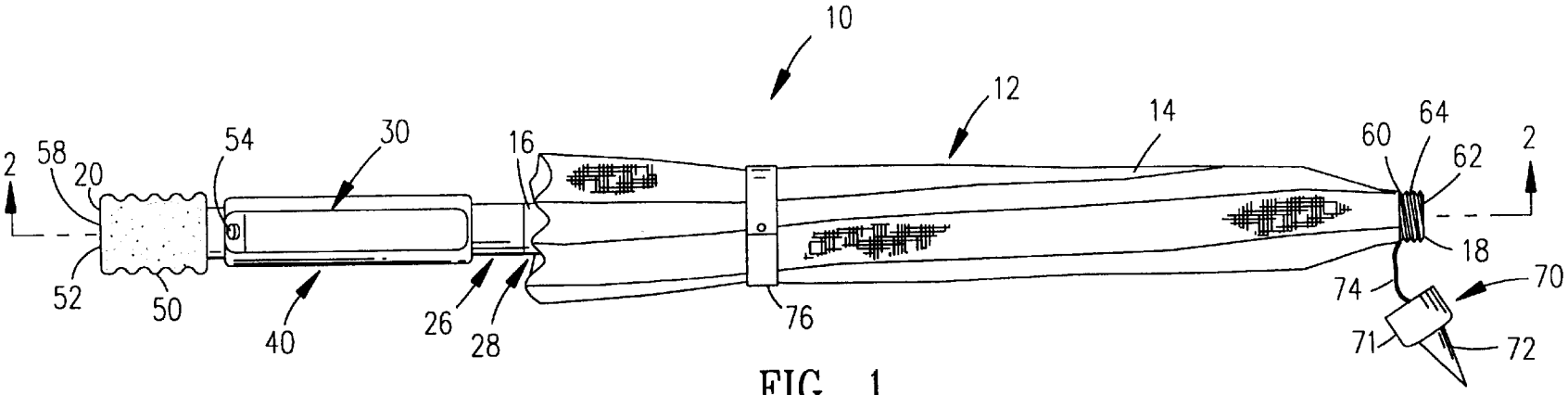
FIG. 1 is a view in side elevation of a preferred embodiment of the combination portable umbrella and air blower apparatus.
Figure 2:
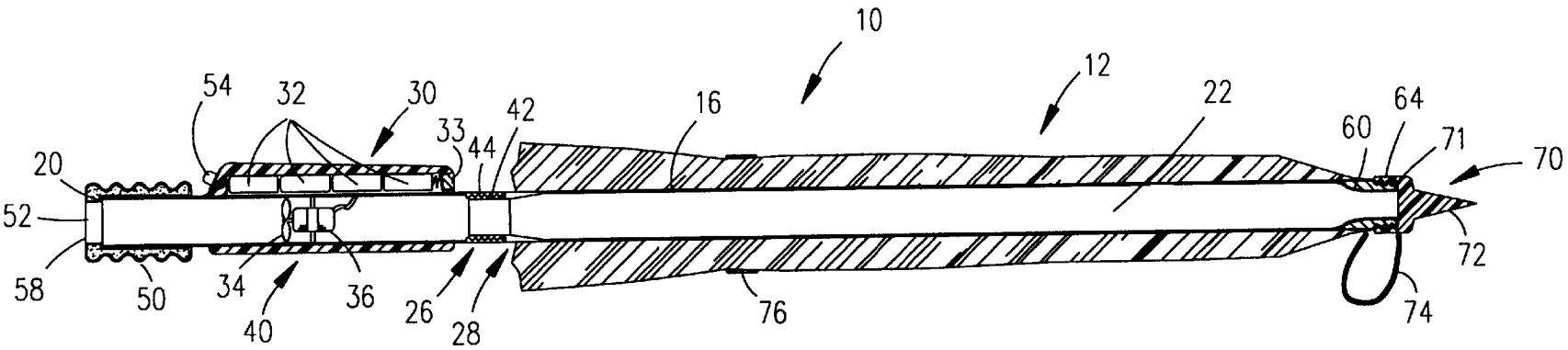
FIG. 2 is a sectional view of the preferred embodiment for the combination portable umbrella and air blower apparatus of FIG. 1 taken along the line 2—2.

Looking more particularly to the drawings, FIG. 1 depicts in side elevation a combined portable umbrella and air blower apparatus, which is indicated generally at 10, according to a preferred embodiment of the present invention. Apparatus 10 comprises an umbrella portion 12 and a handle portion 40, with a fan 34 driven by a fan motor 34, which is shown in FIG. 2, for enabling a clearing of debris from a surface by air propelled from the fan 34 while enabling a protection from adverse weather conditions by the umbrella portion 12.

Figure 3:
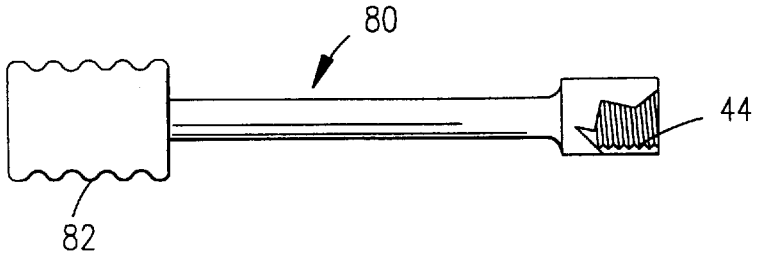
FIG. 3 is a view in side elevation of a replacement member.

More particularly, apparatus 10 has an umbrella portion 12 and a fan 34 that draws air into an air inlet 52 that is formed at a second end 20 of an elongate shaft 16 and within a hand grip 50. When the apparatus 10 is activated by an electrical switch 54, air is propelled through an air conduit 22 and out an air outlet 62 for enabling a clearing of leaf debris and similar obstructions that may lie in the path of a golf ball on a golf green, none of which are shown. As a result, a player's chance of putting the golf ball well is improved. The umbrella portion 12 with the umbrella canopy 14 can also be used independently, devoid of the fan 34, as a protective shield from the elements when used with a replacement member 80, which is shown in FIG. 3.

The umbrella portion 12 consists of an umbrella canopy 14 with a band 76 for keeping the umbrella canopy 14 in a closed position when the apparatus 10 is being used to clear debris from a golf green and when it is not being used for protection from the elements. The elongate shaft 16 has an air conduit 22 formed therein, the elongate shaft further comprises a second shaft section 28. The air conduit 22 is a smooth-walled elongate hollow tube without wall openings along its length. The air outlet 62 is disposed at a first end 18 of the elongate shaft 16 for discharging air through a nozzle 60. The nozzle 60 has a nozzle male thread 64 onto which a removable cap 70 with a removable cap female thread 71 may be threaded. When the apparatus 10 is in use for removing debris, the removable cap 70 is removed. When the apparatus 10 is not in use, the removable cap 70 is threaded onto the nozzle 60 thereby closing the air outlet 62 and preventing foreign material from entering and being lodged in the air conduit 22.

The removable cap 70 also has a spike 72. When the spike 72 is inserted into the ground, it allows a free standing relationship between the ground and the apparatus 10 for use when the apparatus 10 is not needed, for example, around a golf green that is already free or cleared of debris. When a subsequent golf green in need of debris removal is encountered, the removable cap 70 is removed and the apparatus may be used again as intended.

To prevent accidental loss of the removable cap 70 when it is removed during use, and to avoid interference of the removable cap 70 with the air passing through the nozzle 60, a tether 74 is flexibly attached to the removable cap 70. The tether 74 has sufficient length for wrapping around the umbrella canopy 12 and for securing the tether 74 and the removable cap 70 to the umbrella canopy 12 with a half knot. The tether 74 and the removable cap 70 may also be secured to the umbrella canopy 12 by use of an additional band (not shown) similar to the band 76. The additional band may be positioned near the first end 18 of the elongate shaft 16 to hold the tether 74 and the removable cap 70 in place prior to using the apparatus 10.

The handle portion 40 comprises a first shaft section 26 defined by the elongate shaft 16 and the air conduit 22, which extend from the umbrella portion 12 into the handle portion 40 when assembled as shown in FIG. 1 and in FIG. 2. A retained power source casing 30 that is selectively removable is mounted on the handle portion 40. The electrical switch 54 is mounted on the retained power source 30 for packaging convenience. By minimizing the length of electrical wire leads and connections, the air conduit 22 is kept relatively free of electrical wires that may unduly impede airflow therethrough. The electrical switch 54 is electrically connected to a plurality of d.c. batteries 32, which are contained in the retained power source casing 30 and to an air propulsion mechanism which is the fan 34. The plurality of d.c. batteries 32 have sufficient capacity to power the fan motor 36 that operates the fan 34 coupled to the fan motor 36. The fan 34 and the fan motor 36 are each disposed in the air conduit 22 of the first shaft section 26 of the handle portion 40.

The hand grip 50 disposed at the second end 20 of the elongated shaft 16 of the first shaft section 26 of the handle portion 40 allows a user to grasp the apparatus 10 and also allows air to enter the air inlet 52 formed at the second end 20 of the elongated shaft 16 and to enter into the hand grip 50 when the apparatus 10 is activated by the electrical switch 54. Although not necessary for operation, to prevent debris from being ingested into the air inlet 52, a screen 58, preferably, is provided. The screen 58 preferably is made from a mesh that has sufficient open area to minimize pressure drop through the air conduit 22 during operation.

There is also provision on the apparatus 10 for a means for disengaging and a means for coupling the umbrella portion 12 to the handle portion 40. The means for disengaging and coupling is achieved by use of a male thread 42 disposed on the second shaft section 28 of the elongate shaft 16 and a female thread 44 disposed on the first shaft section 26 of the handle portion 40. The replacement member 80, shown in FIG. 3, which has the female thread 44, may be used in place of the handle portion 40 when needed whereby the apparatus 10 is rendered significantly lighter and more convenient in use.

FIG. 2 is a sectional view of the preferred embodiment for the combination portable umbrella and air blower apparatus 10 of FIG. 1 taken along the line 2—2. As shown in FIG. 2, the elongate shaft 16 has the first end 18 and the second end 20 and the air conduit 22 with the first end 62 comprising the air outlet 62 and the second end 52 comprising the air inlet 52. The air outlet 62 of the air conduit 22 is coincident with the first end 18 of the elongate shaft 16. The air conduit 22 is operably associated with the elongate shaft 16 and with the fan 34 and the fan motor 36. The retained power source casing 30, being selectively removable from the umbrella portion 12, has a power source cover 33 to allow insertion and removal of the power source 32 contained therein.

FIG. 3 is a view in side elevation of the replacement member 80 for use with the apparatus 10 when it is apparent that the fan 34 is not needed or desired thereby to render the combination portable umbrella and air blower apparatus 10 lighter and more manageable. The replacement member 80 has the female thread 44 on one end and a handgrip 82 disposed on the opposite end of the replacement member 80. The selective use of the replacement member 80 allows the user the option of being able to use only the umbrella portion 12 independently of the combination portable umbrella and air blower apparatus 10.

To use the replacement member 80, the fan 34 with the fan motor 36 mounted in the air conduit 22 and the power source casing 30 of the first shaft section 26 are removed intact from the second shaft section 28 by disengaging the second shaft section 28 that has the male thread 42 from the first shaft section 26 that has the female thread 44. The removed first shaft section 26 may be conveniently stored in the golf bag during seasons when debris such as leaves are not abundantly present on the golf green thereby being readily available for future use when needed. The replacement member 80 is substituted for the first shaft section 26 and is selectively coupled to the second shaft section 28 that has the male thread 42 which engages the female thread 44 of the replacement member 80. With the replacement member 80 installed on the second shaft section 28, protection from the elements is provided by the umbrella portion 12 and the umbrella canopy 14 independently of the first shaft section 26.

Figure 4:
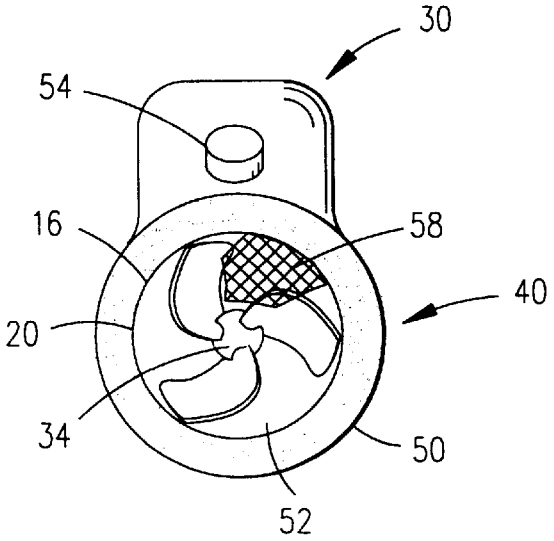
FIG. 4 is a view in rear elevation of the combination portable umbrella and air blower apparatus.

FIG. 4 is a view in rear elevation of the combination portable umbrella and air blower apparatus 10 showing the handle portion 40 with the hand grip 50 and the retained power source casing 30 with the electrical switch 54 mounted thereon for activating the fan 34. The screen 58, prevents ingestion of debris into the air inlet 52 during operation when the electrical switch 54 is activated allowing the fan 34 to draw air into the air inlet 52 and to discharge the air out the air outlet 62.

Figure 5:
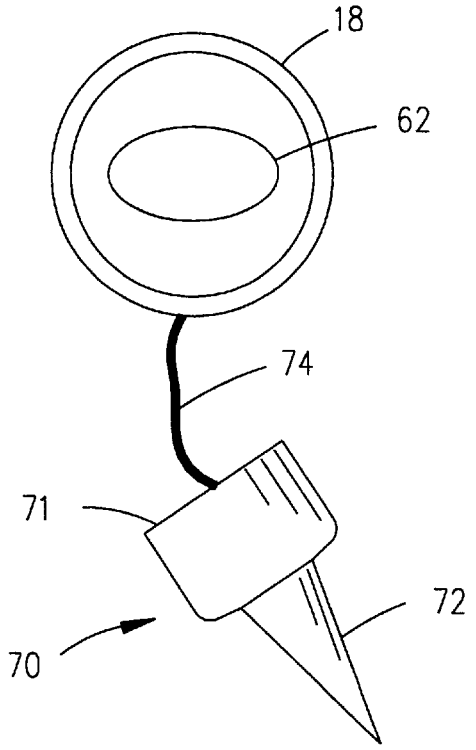
FIG. 5 is a view in front elevation of the combination portable umbrella and air blower apparatus.

FIG. 5 is a view in front elevation of the combination portable umbrella and air blower apparatus 10 showing an end view of the air outlet 62 at the first end 18 of the air conduit 22 and the front view of the tether 74 and the removable cap 70. The removable cap 70 is protectively engaged with the air outlet 62 for selectively shielding the air outlet 62 so that the combination portable umbrella and air blower apparatus 10 can be carried in an upright position during adverse weather conditions without water or dirt contamination of the fan 34, the fan motor 36 and the air conduit 22.

To use the present invention, a user may orient the combined portable umbrella and an air blower apparatus 10 toward debris in need of clearing from a surface such as a golf green while grasping either or both the hand grip 50 and the finger grip 46 of the handle portion 40. Upon activating the electrical switch 54, electrical energy from the power source 32 is used to operate the fan 34 and the fan motor 36. Air is drawn into the apparatus 10 through the air inlet 52 and travels through the air conduit 22, which is an elongate hollow tube without any wall openings. Air is then discharged through the nozzle 60 at an increased velocity whereby debris on a surface in the path of the airflow is cleared from the path.

The umbrella portion 12 of the apparatus 10 is connected to the handle portion 40. Each portion operably communicates with the other by coupling and disengaging from with male and female threaded portions as indicated by the male thread 42 and by the female thread 44. Preferably, the elongate shaft 16 of the umbrella portion 12, has the male thread 42 disposed thereon and the elongate. shaft 16 has the female thread 44 disposed thereon to allow an axially mating sealable alignment with the handle portion 40 for coupling and disengaging purposes and to permit propelled air to traverse the length of air conduit 22 of the elongate shaft 16.

The elongate shaft 16 may be made from metal, plastic, or any other suitable material. The shape of the elongate shaft 16 preferably is round, but square or other geometric shapes or hybrid combinations thereof can also be employed to accommodate various styles, shapes and sizes of fans and motors without departing from the scope of this disclosure. The air conduit 22 preferably has smooth and airtight interior walls to minimize air turbulence, pressure drop, and air leakage during operation of the fan 34. The umbrella canopy 14 of the umbrella portion 12 may be fabricated from umbrella parts and by methods commonly known in the umbrella art employing metal or plastic ribs and nylon or plastic fabric or other water resistant material for the umbrella canopy 14. The nozzle 60 is preferably made from metal, plastic or any other suitable material. The nozzle 60 may be formed as a portion of the elongate shaft 16 at the first end 18 during manufacture by swaging or molding. The removable cap 70 also may be formed from any suitably durable material. The tether 74 may be made of nylon cord or any other suitable material having a length sufficient enough for wrapping around a circumference of the umbrella canopy 14 in the vicinity of the air outlet 62. The retained power casing 30 preferably is made from plastic by injection molding and is slidably fitted by friction to the handle portion 40 and to the first shaft section 26 of the elongate shaft 16 for ease of manufacture and assembly. The handgrip 50 may be plastic, wood, metal or cork and preferably has a gripping surface thereon for comfort in operating the apparatus 10. The electrical switch 54 is preferably a push button switch that can be conveniently mounted on the retained power casing 30.

One practical advantage of the invention is that it provides an efficient, convenient, practical, low cost and versatile apparatus for a combined portable umbrella and air blower for enabling a clearing of debris from a surface by air propelled from the air blower while enabling a protection from adverse weather conditions by the umbrella. Furthermore, the apparatus provides convenience, timesavings, fun and a potential for lowered golf scores. Of course, a wide variety of further uses and advantages of the present invention will become readily apparent to one skilled in the art.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim:

1. A combined portable umbrella and air blower for enabling a clearing of debris from a surface by air propelled from the air blower while enabling a protection from adverse weather conditions by the umbrella, the combined portable umbrella and air blower comprising:

an elongate shaft with a first end and a second end;

an umbrella canopy coupled to the elongate shaft adjacent to the first end of the elongate shaft wherein the umbrella canopy projects radially from the elongate shaft when in an open position for providing protection from adverse weather conditions;

an air conduit operatively associated with the elongate shaft wherein the air conduit has a first end comprising an air outlet that is coincident with the first end of the elongate shaft, a second end comprising an air inlet, and a body portion devoid of air-conveying openings therealong; and an air propulsion mechanism comprising a fan operably coupled to the second end of the elongate shaft for enabling a clearing of debris from a surface external to the combined umbrella and air blower by propelled air wherein the air propulsion mechanism is operably associated with the air conduit for drawing air into the air inlet and propelling air from the air outlet.

2. The combined portable umbrella and air blower of claim 1 wherein the air conduit is elongate and is disposed within the elongate shaft whereby air is propelled by the air propulsion mechanism along the elongate shaft and out of the air outlet at the first end of the elongate shaft.

3. The combined portable umbrella and air blower of claim 2 wherein the elongate air conduit comprises an elongate hollow tube.

4. The combined portable umbrella and air blower of claim 1 further comprising a removable cap protectively engaged with the air outlet for selectively closing and shielding the air outlet whereby the combined portable umbrella and air blower can be carried in an upright position during adverse weather conditions without contamination of the air propulsion mechanism and whereby the removable cap can be removed to allow air to be propelled through the air outlet by the air propulsion mechanism.

5. The combined portable umbrella and air blower of claim 4 further comprising a tether for preventing a loss of the removable cap when the removable cap is removed from the air outlet.

6. The combined portable umbrella and air blower of claim 5 further comprising a means for creating a free-standing relationship between the combined portable umbrella and air blower and a supporting portion of ground.

7. The combined portable umbrella and air blower of claim 6 wherein the means for creating a free-standing relationship comprises at least one spike fixed to the removable cap for being inserted into a supporting portion of ground.

8. The combined portable umbrella and air blower of claim 1 further comprising a power source casing coupled to the elongate shaft for containing a power source wherein the power source casing is selectively removable from the elongate shaft whereby a user can selectively remove the power source casing and a retained power source from the elongate shaft when it is apparent that the air blower is not needed or desired thereby to render the combined portable umbrella and air blower lighter and more manageable.

9. A combined portable umbrella and air blower for enabling a clearing of debris from a surface by air propelled from the air blower while enabling a protection from adverse weather conditions by the umbrella, the combined portable umbrella and air blower comprising:

an elongate shaft with a first end and a second end;

an umbrella canopy coupled to the elongate shaft adjacent to the first end of the elongate shaft wherein the umbrella canopy projects radially from the elongate shaft when in an open position for providing protection from adverse weather conditions;

an elongate air conduit disposed within the elongate shaft wherein the air conduit comprises an elongate hollow tube with a first end comprising an air outlet that is coincident with the first end of the elongate shaft, a second end comprising an air inlet, and a body portion that is devoid of air-conveying openings therealong;

an air propulsion mechanism operably coupled to the second end of the elongate shaft for enabling a clearing of debris from a surface external to the combined umbrella and air blower by propelled air wherein the air propulsion mechanism is operably associated with the air conduit for drawing air into the air inlet and propelling air from the air outlet whereby air is propelled by the air propulsion mechanism along the elongate shaft and out of the air outlet at the first end of the elongate shaft and wherein the air propulsion mechanism comprises a fan disposed in the elongate hollow tube.

10. The combined portable umbrella and air blower of claim 9 wherein the elongate air conduit extends from the first end of the elongate shaft to the second end of the elongate shaft whereby the first end of the elongate shaft comprises the air outlet and the second end of the elongate shaft comprises the air inlet.

11. The combined portable umbrella and air blower of claim 10 wherein the first end of the elongate shaft further comprises a nozzle for focusing and directing air propelled by the air propulsion mechanism.

12. A combined portable umbrella and air blower for enabling a clearing of debris from a surface by air propelled by the air blower while enabling protection from adverse weather conditions by the umbrella, the combined portable umbrella and air blower comprising:

an elongate shaft with a first end and a second end;

an elongate air conduit disposed within the elongate shaft wherein the elongate air conduit has a first end comprising an air outlet that is coincident with the first end of the elongate shaft, a second end comprising an air inlet, and a body portion that is devoid of air-conveying openings therealong;

an umbrella canopy coupled to the elongate shaft adjacent to the first end of the elongate shaft wherein the umbrella canopy projects radially from the elongate shaft when in an open position for providing protection from adverse weather conditions; and an air propulsion mechanism comprising a fan coupled to the second end of the elongate shaft and operably associated with the air conduit for drawing air into the air inlet and propelling air from the air outlet.

13. The combined portable umbrella and air blower of claim 12 further comprising a hand grip and a power source casing coupled to the elongate shaft for containing a power source wherein the air propulsion mechanism and the power source casing are disposed adjacent to the second end of the elongate shaft and further comprising a means for selectively disengaging the air propulsion mechanism and the power source casing from the combined portable umbrella and air blower.

14. The combined portable umbrella and air blower of claim 13 wherein the elongate shaft comprises a first shaft section and a second shaft section, wherein the umbrella canopy is coupled to the first shaft section, wherein the air propulsion mechanism and the power source casing are coupled to the second shaft section, and further comprising a means for selectively coupling the first shaft section to the second shaft section whereby the air propulsion mechanism and the power source casing can be removed from the first shaft section by disengaging the second shaft section from the first shaft section when it is apparent that the air blower is not needed or desired thereby to render the combined portable umbrella and air blower lighter and more manageable.

15. The combined portable umbrella and air blower of claim 14 further comprising a replacement member, a hand grip coupled to the replacement member, and a means for selectively coupling the replacement member to the first shaft section whereby the combined portable umbrella and air blower can be employed as a traditional umbrella devoid of an air blower.

* * * * *